United States Patent [19]

Piesik

[11] 4,134,327

[45] Jan. 16, 1979

[54] ROCKET LAUNCHER TUBE POST-LAUNCH REAR CLOSURE

[75] Inventor: Edward T. Piesik, Pomona, Calif.

[73] Assignee: General Dynamics Corporation, Pomona, Calif.

[21] Appl. No.: 860,039

[22] Filed: Dec. 12, 1977

[51] Int. Cl.[2] ..... F14F 3/04

[52] U.S. Cl. ..... 89/1.8; 89/1.812; 89/1.816

[58] Field of Search ..... 244/114 B, 114 R; 169/54; 89/1.8, 1.806, 1.809, 1.810, 1.812, 1.815, 1.816, 1.817, 1.819, 1.703, 1.704, 1.818

[56] References Cited

U.S. PATENT DOCUMENTS

| | | | |
|---|---|---|---|
| 2,445,423 | 7/1948 | Eastman | 89/1.8 X |
| 3,011,406 | 12/1961 | Werle et al. | 89/1.818 |
| 3,052,303 | 9/1962 | Lapp | 89/1.8 UX |
| 3,076,385 | 2/1963 | Barnhoft | 89/1.806 |
| 3,081,970 | 3/1963 | Einarsson | 244/114 B |
| 3,226,063 | 12/1965 | Wagner | 244/114 B |
| 3,228,296 | 1/1966 | Neuman et al. | 89/1.8 |
| 3,645,478 | 2/1972 | Madelung | 244/114 B |
| 4,044,648 | 8/1977 | Piesik | 89/1.8 |

*Primary Examiner*—David H. Brown
*Attorney, Agent, or Firm*—Henry B. Bissell; Edward B. Johnson

[57] ABSTRACT

A rear door for a rocket launch tube provided to prevent rocket exhaust gas flow into an empty launch tube from an associated multiple-rocket plenum chamber. The door is maintained in a stored position while a missile is in the launch tube and is activated when the missile leaves the launcher. The door may be latched open and released by a sensor device at a selected position of the missile as it is leaving the launch tube. Preferably, gases from the launching missile power closure of the door, once the door is released from its open latched position. Once the door closes, a second latch locks it in place to seal off the launch tube from the plenum chamber.

14 Claims, 5 Drawing Figures

ROCKET LAUNCHER TUBE POST-LAUNCH REAR CLOSURE

BACKGROUND OF THE INVENTION

1. Field of the Invention

This invention relates to the field of controlled flow, exhaust manifold systems and, more particularly, to apparatus for sealing off an empty launch tube from a plenum chamber serving as a common exhaust manifold for a plurality of missile launch tubes.

2. Description of the Prior Art

In many military applications, rockets or missiles are stored or disposed in closely adjacent magazine chambers or launch tubes. Exhaust gas outlets are normally provided, even from magazine storage chambers, to duct rocket exhaust gases generated during intended or accidental rocket ignitions to a safe location. Where available space is at a premium, for example on shipboard, manifolding of a number of launch tubes or chambers into a common exhaust duct or plenum tube is often necessary.

Obviously problems exist if ducts connecting the launch tubes or chambers to the common exhaust manifold are always or normally open. When one (or more) of the rockets is intentionally or accidentally ignited, at least portions of the resulting exhaust gases, which may be at about 6000° F., will be circulated through the common manifold and into other chambers through the open connecting ducts. Rockets and rocket warheads in these other chambers are very likely to be ignited or detonated by these hot exhaust gases. If these other rocket chambers are open at upper ends, as are some launch tubes and storage compartments, exhaust gases entering the chambers through the connecting ducts escape through the open ends and may cause extensive heat damage to adjacent installations.

To prevent such occurrences, some type of safety door or gas valve is normally installed either at the outlet opening of each rocket chamber or in the connecting duct to the exhaust manifold. When a rocket is accidentally or intentionally ignited, the associated safety door or gas valve is caused to open—usually by the exhaust blast—to admit the exhaust gases into the manifold. The doors or valves associated with other chambers are maintained in a closed condition to prevent circulation of the exhaust gases thereinto.

The patent disclosures, for example, of Eastman and Neuman et al (U.S. Pat. Nos. 2,445,423 and 3,228,296, respectively) illustrate use of such doors or valves. Previously available or disclosed apparatus, however, have substantial disadvantages. For example, the patent of Neuman et al discloses at the bottom of each compartment of a multiple rocket storage magazine, a non-hinged, "blow out" door. These doors lead through conducting ducts to a common exhaust manifold. If any of the rockets in the magazine are accidentally ignited (for example by enemy fire), the force exerted by the resulting rocket exhaust gas on the upper surface of an associated door blasts the door out of its opening and admits the gases into the manifold. An associated fire extinguishing system is designed to direct pressurized water through the resulting opening and extinguish the rocket. A major disadvantage, however, is that no means are provided for automatically reclosing the door after the rocket has been extinguished. Unless the blow-out door is manually replaced—for which little provision seems to have been made—hot exhaust gases from subsequent accidential ignition of another rocket would enter the compartment and could cause reignition of the rocket or explosion of its warhead before such next-firing rocket is extinguished. In addition, if the compartments are not sealed in upper regions—which they do not seem to be—hot exhaust gases from the next firng rocket would be conducted through any compartments containing previously ignited rockets and directly to the rocket launching platform positioned just above the magazine.

The patent of Eastman discloses apparatus adapted for storing a number of rockets, wherein exhaust nozzles of the rockets are seated in sealing relationship upon short ducts or nozzle extensions leading to a common exhaust manifold. Toggle clamps are used to hold the noses of the rockets in the storage apparatus and no actual storage compartments are formed. Each nozzle extension has, at its lower end, a pair of hinged doors, spring biased to a normally closed condition. Exhaust gas pressure from an accidentally ignited rocket forces the associated nozzle extension doors to swing open against the springs, thereby admitting the gases to the manifold, from which they are discharged at a remote location. The resulting gas pressure in the manifold acts upon under sides of other closed doors to force them tightly closed and prevent circulation of hot exhaust gases into the other nozzle extensions.

However, the door hinges and biasing springs are positioned directly in the path of hot exhaust gas flow from an associated firing rocket and will receive maximum heating and erosion therefrom. As a result of heat and erosion damage, the doors immediately below a firing rocket, even if not burned completely loose, as is likely, would probably fail to return to the closed condition after the firing. Also, very possibly, heat from hot exhaust gases flowing through the manifold would damage the biasing springs of other doors. Even if these doors were kept closed by pressure in the manifold during that particular firing, they might subsequently sag open. Then upon a next accidental rocket firing, the flow of gases through the manifold could force the sagging doors open, rather than closed, allowing circulation of the hot gases into nearby nozzle extensions with consequent ignition of the associated rockets.

Even through spring-loaded flow control doors might be satisfactory for use associated with storage of small rockets, wherein firing is unlikely and when it occurs the firing time is short, such doors would be entirely unsatisfactory in applications in which they would be subjected to repeated or sustained rocket exhaust gas flows. They would thus be unsatisfactory for use associated with storing or launching large rockets or missiles or with launch tubes from which the large number of even small rockets would be fired.

Other patents disclosing special configured, exhaust acutated doors or closures are U.S. Pat. No. 3,081,970 of Einarsson and U.S. Pat. No. 3,436,036 of Madelung. However, these are particularly related to aircraft of the vertical take-off and landing type (VTOL) and are not considered applicable to the systems of the type herein disclosed.

The Piesik patent 4,044,648 solves the problems mentioned with respect to the Neuman and Eastman patents. The present invention is particularly directed to the specific problem of reclosing the rear of a launch tube after the missile has cleared the launcher. This is accomplished in a simple, positive manner such that fuel-rich hot exhaust from adjacent firing missiles is prevented from circulating with the available air in the now-empty launch tube. Such mixing is undesirable because the mixture of hot fuel-rich exhaust and air can potentially combust or detonate, causing structural damage. In addition the launch tube need only be designed to withstand a single launch rather than the cumulative effects of the exhaust flow from multiple launchings of adjacent missiles.

SUMMARY OF THE INVENTION

In brief, arrangements in accordance with the present invention comprise rocket launching systems for storing and launching a plurality of missiles. These missiles are stored in generally upright attitude in missile launch tubes having their lower ends coupled to a common plenum or exhaust manifold extending underneath the launch tubes and communicating therewith. Prior to launch, each launch tube is preferably partitioned off from the plenum chamber by a protective seal which serves to prevent the exhaust from another rocket being fired from entering the launch tubes with unfired missiles therein. This protective seal is blown away by the exhaust upon firing and it is important to be able to seal off the opening of an empty launch tube within a very short time after the missile is fired Furthermore, it is particularly desirable to be able to close off the empty launch tubes by means of devices which are essentially faired into the adjacent surface of the plenum chamber in order to avoid, to the extend feasible, the development of any pockets or stagnation regions in which possibly explosive mixtures of raw exhaust gases and air might build up.

Because there may be multiple firing of missiles in rapid succession, it is important to be able to seal off the bottom of the tubes from which missiles are launched within a very shot time after ignition. Yet because of structural limitations in the individual launch tubes, the bottom of a launch tube should not be closed off too soon after ignition or the exhaust gases from the missile leaving the launch tube may tend to rupture or otherwise damage the launch tube. Particular arrangements in accordance with the present invention accomplish the desired objective by timing the closing of the bottom end of the launch tube to occur as the missile reaches a predetermined position relative to the launch tube during the launch procedure.

In one particular arrangement in accordance with the present invention, this is accomplished by providing a detector or sensor partway up the launch tube so as to detect the passage of the missile past that point and using the sensor output signal to control the release of a door which thereafter swings into position to close of the bottom of the launch tube. Provision is also made for the door to latch in the closed position so as to positively prevent any exhaust gases coming back up into an empty launch tube from the associated exhaust plenum chamber.

In another particular arrangement in accordance with the invention, the door is held in the stowed position by a latching arrangement which is released by the force of the exhaust of the missile leaving the launch tube on a shutter or damper selectively positioned to time the release of the door from the stowed position by relation to the passage of the missile past a preselected point in the launch tube.

In still another arrangement in accordance with the present invention, the door is retained in the stowed position by a latch mechanism which requires a predetermined force to release it. The door is provided with an extension flap which projects partly into the missile exhaust stream and develops the necessary force to release the door from the stowed position after the missile has reached a predetermined position during launch.

BRIEF DESCRIPTION OF THE DRAWING

A better understanding of the present invention may be had from a consideration of the following detailed description, taken in conjunction with the accompanying drawing in which.

DESCRIPTION OF THE PREFERRED EMBODIMENTS

Figure 1:
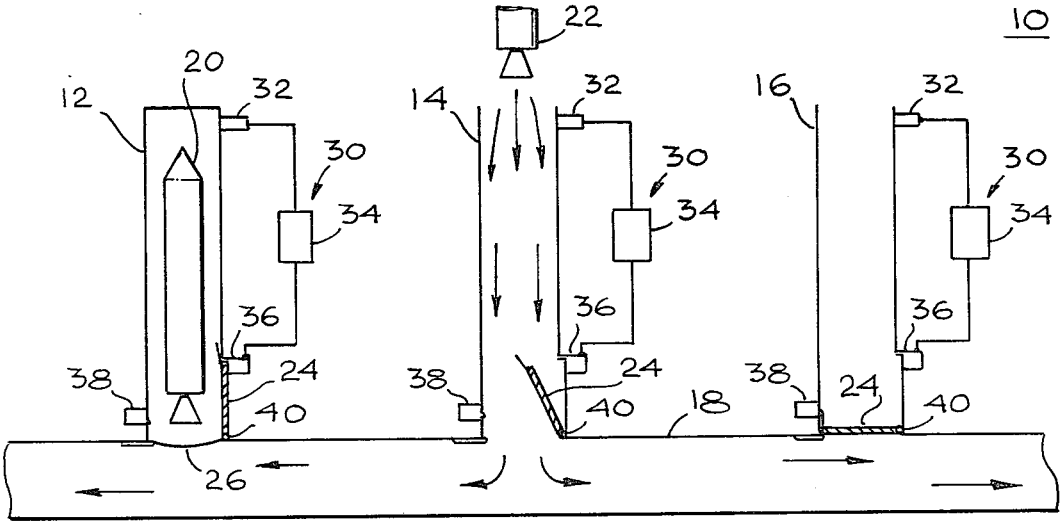
FIG. 1 is a schematic elevational view of a missile storage and launch system incorporating one particular embodiment of the present invention.

As shown in FIG. 1, a missile launch system 10 includes a plurality of launch tubes 12, 14 and 16 in generally upright attitude coupled to a common exhaust plenum or manifold 18 extending generally horizontally underneath the respective launch tubes. Each of the launch tubes 12, 14, and 16 communicates with the plenum 18 during the time that its corresponding missile is being launched in order that the exhaust gases from the missile may be diected laterally through the plenum 18 and carried safely away for ultimate release from the system.

For purposes of illustration, the launch tube 12 is shown containing an unfired missile 20, the launch tube 14 is shown with an associated missile 22 leaving the launch tube during the launch procedure, and the launch tube 16 is shown empty in a condition following the launching of its missile. Each of the launch tubes 12, 14 and 16 has associated therewith a closure door 24 which is provided in accordance with an aspect of the invention for the purpose of closing off the bottom end of the associated launch tube at the juncture of the plenum chamber therewith after the missile has been launched. Shown associated with the launch tube 12 containing the still unfired missile 20 is a protective seal 26 which may be the type disclosed in the above-referenced exemplary prior art. This protective seal 26 is of a type which is blown away or rendered ineffective for closing off the lower end of the launch tube from the plenum chamber 18 when the associated missile is fired. The door 24 of the launch tube 12 containing the still unfired missile 20 is shown in the stowed position recessed slightly into the side wall of the launch tube 12. The closure door 24 of launch tube 14 from which the missile 22 is being launched is shown moving from the stowed position to the position of closure for the launch tube. The door 24 of the launch tube 16 from which a missile has previously been launched is shown in the closed and locked position in which it effectively blocks any exhaust gases in the plenum chamber 18 from exiting through the empty launch tube 16.

Associated with each of the launch tubes 12, 14 and 16 is a corresponding system 30 for controlling the release of the door 24. As shown in FIG. 1, the control system 30 includes a missile clear sensor 32 capable of generating an actuation signal to a control box 34 as the missile reaches a particular point in its launch procedure. In turn, the control box 34 activates a latch release mechanism 36 to release the associated door 24 from its stowed position. The latch release mechanism 36 preferably includes a latch for retaining the door 24 in stowed position until actuated by the control box 34. A second latch 38 is provided near the base of the launch tube 12, 14 or 16 to lock the door 24 in the closed position. The door 24 is suspended in conventional fashion by a hinge or other pivot mechanism 40 at the base of the door 24.

Figure 2:
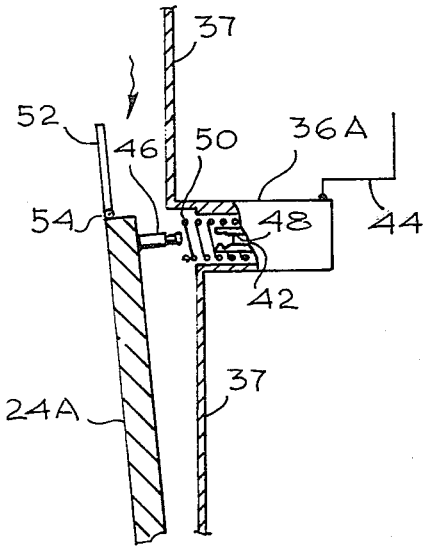
FIG. 2 is a sectional view, partially broken away, of a portion of the arrangement of FIG. 1.

The latch and release mechanism 36 may comprise any of a number of various specific devices having the desired capability. As shown in FIG. 2, the latch and release mechanism 36A is shown comprising a solenoid 42 coupled via a lead 44 which extends to the control box 34. The door 24A as shown in FIG. 2 includes a hasp 46 for releasable coupling to a retention or latching member 48 operatively associated with the solenoid 42. A compression spring 50 is also shown for biasing the door 24A outwardly against the latching mechanism so that the door 24A moves outwardly from the stowed position upon release of the hasp 46 by the solenoid latch 48. The door 24A also has a pivotable extension member 52 pivotably mounted thereto by a hinge 54. In the position shown in FIG. 2, the member 52 serves to catch a portion of the exhaust stream as soon as the latching mechanism 48 is released, thus serving to positively draw the door 24A out of its stowed position.

Figure 3:
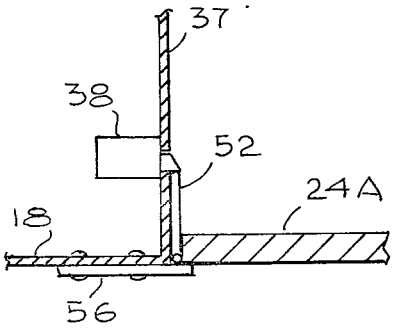
FIG. 3 is a sectional view of another portionof the arrangement of FIG. 1.

As seen in FIG. 3, the pivotable member 52 also assists in locking the door 24A in its closed position across the bottom of its associated launch tube. In FIG. 3, the second latch 38 is shown engaging the member 52 to prevent the door 24A from lifting upwardly under the pressure of exhaust gases in the associated plenum 18. A strip 56 is shown fastened to the upper wall of the plenum 18 to provide a lip supporting the door 24A against moving downward into the plenum 18 when it closes.

Figure 4:
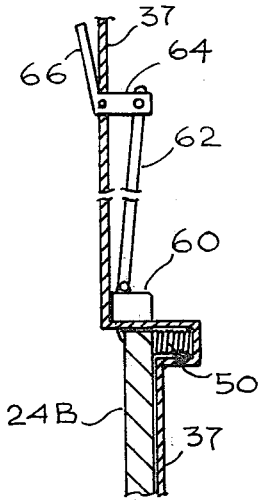
FIG. 4 is a sectional view, partially broken away, of an alternative embodiment of the present invention.

FIG. 4 illustrates an alternative arrangement for the first latch mechanism to retain the door in stowed position and to release it at the appropriate time during launching of the missile. The arrangement of FIG. 4 is shown comprising a latch 60 having a conventional spring loaded release mechanism mounted to retain the door 24B in stowed position against the lower wall 37 of the launch tube. A compression spring 50 is provided as before to bias the door 24B outwardly as previously described. Coupled to the latch mechanism 60 via a link 62 is a lever member 64 which is pivotably mounted to the launch tube wall 37. The lever 64 extends through the wall 37 and has a vane 66 projecting into the launch tube so that as the missile is being launched, its exhaust gases deflect the vane 66, causing it to move the lever 64 and release the latch 60 so that the door 24B can move down into place, sealing off the bottom of the associated launch tube.

Figure 5:
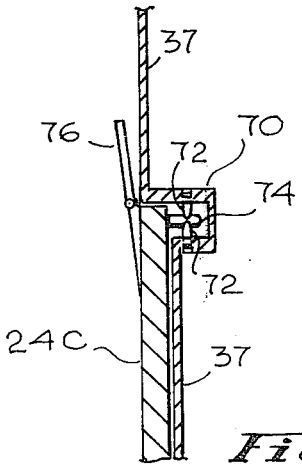
FIG. 5 is a sectional view, partially broken away, of a second alternative arrangement in accordance with the invention.

FIG. 5 shows another alternative arrangement of a latch and release mechanism for operating the door 24C. The door 24C is shown in stowed position against the lower wall 37 of the launch tube. A spring release mechanism 70 is shown partially broken away and having a pair of releasable fingers 72 engaging a hasp 74 attached to the door 24C. A vane 76, pivotably mounted to the door 24C, is provided to project partially into the exhaust stream of the missile within the launch tube during the launching procedure. As the missile is launched and its tail section lifts past the vane 76, exhaust gases will catch the vane 76 and develop sufficient force to pull the door 24C out of the spring release latch mechanism 70, thus permitting the door to close and seal off the bottom end of the launch tube. The vane 76 is designed to pivot upwardly as the door 24C closes and cooperate with the second latch mechanism 38 in the manner described for the arrangement of FIG. 3.

Various particular arrangements in accordance with the invention have been shown and described hereinabove in connection with the accompanying drawing. The missile clear sensor 32 of the arrangement of FIG. 1 may be positioned at any selected location along the launch tube. It may be actuated mechanically, electrically, electromechanically or otherwise as desired. It can be responsive to the pressure of the exhaust, the temperature of the exhaust, the interruption of a light beam or a trip wire or the like. What is important is that it be reliable in operation so that the stowed door may be released and thereafter slammed shut by the pressure of the exhaust from the launching missile. Once released, the door must be held latched in the closed position to prevent rocket exhaust from the associated plenum chamber being driven up into the empty launch tube. Generally the exit time for the launching missile to clear the launch tube is only a few hundred milliseconds. Thus, the sequence of detection of missile clearance, actuation of the first latch mechanism to release the door and the subsequent closing of the door with its latching by the second latch mechanism in the closed position can take place in a very short time. Once the door has been closed, the system is ready for the next missile firing, subject to the control of the launch crew and any other considerations that may govern the launching.

Although there have been described above specific arrangements of rocket launcher tube post-launch rear closures in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. Launch tube closure apparatus comprising:

a door pivotably mounted at the bottom of a missile launch tube at the junction thereof with an associated plenum chamber for closing off the launch tube from the plenum chamber, the door being pivoted for movement between a stowed position and a closed position;

means for stowing the door recessed into the wall of the launch tube;

first latching means for retaining the door in the stowed position;

second latching means for locking the door in the closed position; and means responsive to the movement of the missile during launching from the launch tube for releasing the first latching means to permit the door to move from the stowed position to the closed position.

2. The apparatus of claim 1 wherein the second latching means comprises a spring biased latch mounted to a wall of the launch tube to engage a portion of the door when in the closed position.

3. The apparatus of claim 1 further including means for ejecting the door from the stowed position into the path of the exhaust gases from the launching missile.

4. The apparatus of claim 3 wherein said last-mentioned means comprises a spring mechanism biased to urge the door out of the stowed position.

5. The apparatus of claim 1 wherein the missile responsive means comprises a pivotably mounted vane which is mechanically linked to the first latching means for releasing the door from the stowed position upon the impingement of exhaust gases from the launching missile against the vane as the missile exhaust passes the position of the vane.

6. The apparatus of claim 5 wherein the vane is pivotably mounted to the wall of the launch tube a predetermined distance above the door in the stowed position, and further including a link extending from the vane to the first latching means to release the latching means upon the pivoting of the vane by the exhaust gases.

7. The apparatus of claim 1 wherein the missile responsive means comprises a sensor selectively positioned along the path of the missile from the launch tube during a launch procedure for providing a signal to release the first latching means.

8. The apparatus of claim 7 wherein the first latching means comprises a solenoid and solenoid actuated latch, and further comprising control means coupled between the sensor and the solenoid for causing the latch to release the door upon the receipt of a signal from the sensor.

9. The apparatus of claim 7 wherein the sensor is mounted on the wall of the launch tube near the upper end thereof for detecting the clearing of the launch tube by the missile.

10. The apparatus of claim 1 wherein the missile responsive means comprises a vane extending into the launch tube for applying force from the missile exhaust gases to release the first latching means.

11. The apparatus of claim 10 wherein the vane is selectively positioned longitudinally along the wall of the launch tube to delay actuation thereof by the missile exhaust gases until the missile has proceeded past a predetermined point during its launch procedure.

12. The apparatus of claim 11 wherein the vane is pivotably mounted to the door and extends upwardly therefrom at an angle to the wall of the launch tube when the door is in the stowed position.

13. The apparatus of claim 12 wherein the first latching means comprises a releasable latch adapted to release the door upon the application of a predetermined force on the vane.

14. The apparatus of claim 13 wherein the vane is pivotably attached to the door for movement into a position extending along the wall of the launch tube to engage the second latching means when the door is in the closed position.

* * * * *